US010849400B2

(12) United States Patent
Weatherly et al.

(10) Patent No.: US 10,849,400 B2
(45) Date of Patent: Dec. 1, 2020

(54) HAIR DRYER

(71) Applicant: Jemella Limited, Leeds (GB)

(72) Inventors: Robert Alexander Weatherly, Cambridgeshire (GB); Matthew James Brady, Cambridgeshire (GB); Jonathan James Larkin, Essex (GB); Timothy David Moore, Hertfordshire (GB); Steve Sayers, Buckinghamshire (GB)

(73) Assignee: Jemella Limited, Leeds (GB)

( * ) Notice: Subject to any disclaimer, the term of this patent is extended or adjusted under 35 U.S.C. 154(b) by 830 days.

(21) Appl. No.: 14/409,619

(22) PCT Filed: Jun. 24, 2013

(86) PCT No.: PCT/GB2013/051648
§ 371 (c)(1),
(2) Date: Dec. 19, 2014

(87) PCT Pub. No.: WO2014/001770
PCT Pub. Date: Jan. 3, 2014

(65) Prior Publication Data

US 2015/0335128 A1 Nov. 26, 2015

(30) Foreign Application Priority Data

Jun. 25, 2012 (GB) ..... 1211253.8
Jul. 20, 2012 (GB) ..... 1212933.4

(51) Int. Cl.
*A45D 20/10* (2006.01)
*A45D 20/12* (2006.01)

(52) U.S. Cl.
CPC ..... *A45D 20/10* (2013.01); *A45D 20/12* (2013.01); *A45D 20/122* (2013.01)

(58) Field of Classification Search
CPC ..... A45D 20/10; A45D 20/122; A45D 20/12; H02M 2001/0009; H02M 2001/0083; H02M 2001/0087
(Continued)

(56) References Cited

U.S. PATENT DOCUMENTS 527,176 A 10/1894 Johnson
824,742 A 7/1906 Richardson
(Continued)

FOREIGN PATENT DOCUMENTS

CN 2503759 Y 8/2002
CN 1477937 A 2/2004
(Continued)

OTHER PUBLICATIONS

British Search Report for corresponding application GB1211231.4; Report dated Oct. 19, 2012.
(Continued)

*Primary Examiner* — Edelmira Bosques
*Assistant Examiner* — Bao D Nguyen
(74) *Attorney, Agent, or Firm* — Schwegman Lundberg & Woessner, P.A.

(57) ABSTRACT

The invention relates to hair dryers. Various techniques for improving air flow in hair dryers are described, including a hair dryer providing laminar flow air. In another variant a hair dryer has a two air flow channels: one a hot air channel the other a cool air channel, with the cool air channel circumscribing the hot air channel. The nozzle end of the hair dryer is arranged such that the cool air channel extends forward of the hot air channel outlet. This allows a hair dryer to be placed close to, or on, a person's hair/head without and risk of burning the person's head. A hair dryer with external power supply is also described which reduces the weight of the housing held by a user.

30 Claims, 12 Drawing Sheets

(58) Field of Classification Search
USPC ..... 34/553
See application file for complete search history.

(56) References Cited

U.S. PATENT DOCUMENTS

| | | | | |
|---|---|---|---|---|
| 866,778 | A | 9/1907 | Eldridge | |
| 3,182,667 | A | 5/1965 | Den | |
| 3,927,684 | A | 12/1975 | Lam | |
| 4,196,343 | A | 4/1980 | Han | |
| 4,267,430 | A | 5/1981 | Downey | |
| 4,354,092 | A | 10/1982 | Manabe et al. | |
| 4,365,140 | A | 12/1982 | Bast et al. | |
| 4,408,282 | A | 10/1983 | Hof | |
| 4,424,437 | A * | 1/1984 | Walter | G05D 23/27 34/553 |
| 4,553,343 | A | 11/1985 | Primati | |
| 4,757,183 | A | 7/1988 | Karey et al. | |
| 4,857,702 | A | 8/1989 | Cafaro | |
| 4,883,942 | A | 11/1989 | Robak, Sr. et al. | |
| 4,917,078 | A | 4/1990 | Zaborowski | |
| 4,953,266 | A | 9/1990 | Trinkaus | |
| 5,124,532 | A | 6/1992 | Hafey et al. | |
| 5,160,831 | A | 11/1992 | Thaler et al. | |
| 5,195,253 | A | 3/1993 | Poumey et al. | |
| 5,223,694 | A | 6/1993 | Tsuji et al. | |
| 5,243,683 | A | 9/1993 | Yang | |
| 5,345,055 | A | 9/1994 | Leung | |
| 5,394,620 | A | 3/1995 | Chimera | |
| 5,400,809 | A | 3/1995 | Adams | |
| 5,794,799 | A | 8/1998 | Collins et al. | |
| 5,857,262 | A | 1/1999 | Bonnema et al. | |
| 5,865,188 | A | 2/1999 | Marquez | |
| 5,938,957 | A | 8/1999 | Tanahashi et al. | |
| 5,952,812 | A * | 9/1999 | Maeda | H02J 7/022 318/803 |
| 6,070,596 | A | 6/2000 | Altamore | |
| 6,119,702 | A | 9/2000 | Habibi | |
| 6,191,930 | B1 | 2/2001 | Ramchandani | |
| 6,199,295 | B1 | 3/2001 | Smal | |
| 6,314,236 | B1 | 11/2001 | Taylor | |
| 6,369,369 | B2 | 4/2002 | Kochman et al. | |
| 6,393,718 | B1 | 5/2002 | Woodard | |
| 6,449,870 | B1 | 9/2002 | Perez et al. | |
| 6,457,953 | B1 | 10/2002 | Bradbury | |
| 6,494,216 | B1 | 12/2002 | Hirata | |
| 6,627,852 | B1 | 9/2003 | Savone | |
| 6,703,587 | B2 | 3/2004 | Sena et al. | |
| 6,732,449 | B2 | 5/2004 | Evanyk | |
| D527,176 | S | 8/2006 | Andre | |
| 7,380,347 | B2 | 6/2008 | Coates et al. | |
| 7,412,781 | B2 | 8/2008 | Mattinger | |
| 7,445,012 | B2 | 11/2008 | Mukai | |
| 7,465,904 | B2 | 12/2008 | Kim | |
| 7,730,895 | B2 | 6/2010 | Maddocks et al. | |
| 7,748,391 | B2 | 7/2010 | Vance | |
| 7,783,177 | B2 | 8/2010 | Ikesaki | |
| 8,013,275 | B2 | 9/2011 | Ng et al. | |
| 8,232,761 | B1 | 7/2012 | Thivierge et al. | |
| 8,541,715 | B2 | 9/2013 | Overend et al. | |
| 8,544,476 | B1 | 10/2013 | Marquardt | |
| 8,567,414 | B2 | 10/2013 | Rivola | |
| 8,567,415 | B2 | 10/2013 | Morgandi et al. | |
| 8,776,805 | B2 | 7/2014 | Degrood | |
| 8,890,035 | B2 | 11/2014 | Scheunert et al. | |
| D719,296 | S | 12/2014 | Brady | |
| 9,012,813 | B2 | 4/2015 | Mourad | |
| 9,474,347 | B2 | 10/2016 | Pedroarena | |
| 9,526,311 | B1 | 12/2016 | Schaefer et al. | |
| 9,698,767 | B2 * | 7/2017 | Tuttle | H03K 17/06 |
| 2001/0014373 | A1 | 8/2001 | Lin | |
| 2002/0157276 | A1 | 10/2002 | Mujica | |
| 2002/0189128 | A1 * | 12/2002 | Nakagawa | A45D 20/12 34/96 |
| 2003/0007872 | A1 * | 1/2003 | Bradbury | F04D 29/384 416/223 R |
| 2003/0089700 | A1 | 5/2003 | Chang | |
| 2004/0003824 | A1 | 1/2004 | Habibi | |
| 2004/0041684 | A1 * | 3/2004 | Mandell | A45D 20/12 338/32 R |
| 2005/0121050 | A1 | 6/2005 | Cha | |
| 2005/0224091 | A1 | 10/2005 | Cafaro et al. | |
| 2006/0081586 | A1 | 4/2006 | Ramsay | |
| 2006/0124922 | A1 | 6/2006 | Kim et al. | |
| 2006/0150996 | A1 | 7/2006 | Lun et al. | |
| 2006/0202852 | A1 | 9/2006 | Peter et al. | |
| 2007/0163614 | A1 | 7/2007 | Ikesaki | |
| 2007/0220773 | A1 | 9/2007 | Evanyk | |
| 2007/0283529 | A1 | 12/2007 | Hashizume | |
| 2007/0283978 | A1 | 12/2007 | Montagnino | |
| 2008/0041409 | A1 | 2/2008 | Leung | |
| 2008/0053982 | A1 | 3/2008 | Ceva | |
| 2008/0087295 | A1 | 4/2008 | Park | |
| 2008/0092915 | A1 | 4/2008 | Chan | |
| 2008/0173322 | A1 | 7/2008 | Leung | |
| 2008/0216859 | A1 | 9/2008 | Chan | |
| 2008/0216860 | A1 | 9/2008 | Legrain | |
| 2008/0236604 | A1 | 10/2008 | Mourad | |
| 2008/0236609 | A1 | 10/2008 | Wong | |
| 2008/0240690 | A1 * | 10/2008 | Ono | A45D 20/10 392/384 |
| 2008/0257372 | A1 | 10/2008 | Mills et al. | |
| 2008/0283080 | A1 | 11/2008 | Habibi | |
| 2009/0005723 | A1 | 1/2009 | Shanks et al. | |
| 2009/0032048 | A1 | 2/2009 | Suzuki et al. | |
| 2009/0044823 | A1 | 2/2009 | Overend et al. | |
| 2009/0114240 | A1 | 5/2009 | Leung | |
| 2009/0159093 | A1 | 6/2009 | Yu | |
| 2009/0293300 | A1 * | 12/2009 | Merritt | A45D 20/12 34/98 |
| 2010/0083978 | A1 | 4/2010 | Hottenrott | |
| 2010/0101598 | A1 | 4/2010 | Ng et al. | |
| 2010/0132733 | A1 | 6/2010 | Kyu et al. | |
| 2011/0017225 | A1 | 1/2011 | Devulapalli | |
| 2011/0056509 | A1 | 3/2011 | Benest et al. | |
| 2011/0079237 | A1 | 4/2011 | Price | |
| 2011/0091251 | A1 | 4/2011 | Kim et al. | |
| 2011/0226277 | A1 | 9/2011 | Choi | |
| 2012/0227758 | A1 | 9/2012 | Ford et al. | |
| 2012/0291797 | A1 | 11/2012 | Degrood et al. | |
| 2013/0239427 | A1 * | 9/2013 | Quessard | A45D 20/10 34/98 |
| 2014/0130365 | A1 | 5/2014 | Dineen | |
| 2014/0338691 | A1 | 11/2014 | Weatherly et al. | |
| 2015/0122792 | A1 | 5/2015 | Moore et al. | |
| 2015/0136169 | A1 | 5/2015 | Moore et al. | |
| 2015/0313339 | A1 | 11/2015 | Moore | |
| 2016/0286928 | A1 | 10/2016 | Weatherly et al. | |

FOREIGN PATENT DOCUMENTS

| | | | |
|---|---|---|---|
| CN | 1665426 | | 9/2005 |
| CN | 1954737 | A | 5/2007 |
| CN | 100858147 | B1 | 9/2008 |
| CN | 102045899 | A | 5/2011 |
| CN | 102448345 | A | 5/2012 |
| CN | 202218686 | U | 5/2012 |
| DE | 3115569 | A1 | 12/1982 |
| DE | 102010002795 | A1 | 9/2011 |
| EP | 2077343 | A1 | 8/2009 |
| EP | 2255692 | A1 | 1/2010 |
| EP | 1951082 | B1 | 10/2011 |
| EP | 2377419 | A1 | 10/2011 |
| EP | 2863770 | A2 | 4/2015 |
| GB | 235937 | | 6/1925 |
| GB | 573009 | | 11/1945 |
| GB | 1519930 | | 8/1978 |
| GB | 2016051 | A | 9/1979 |
| GB | 2067097 | A | 7/1981 |
| GB | 2142817 | A | 1/1985 |
| GB | 2163574 | A | 2/1986 |
| GB | 2167946 | A | 6/1986 |
| GB | 2318544 | A | 4/1998 |
| GB | 2468176 | A | 9/2010 |

(56) References Cited

FOREIGN PATENT DOCUMENTS

| | | | | |
|---|---|---|---|---|
| GB | 2477834 | A | 8/2011 | |
| GB | 2503519 | A | 1/2014 | |
| GB | 2543135 | B | 11/2017 | |
| JP | 08256818 | A | 10/1996 | |
| JP | H08256818 | A | 10/1996 | |
| JP | 2008104499 | A | 5/2008 | |
| JP | 2010274050 | A | 12/2010 | |
| JP | 2012019865 | A | 2/2012 | |
| KR | 20070083323 | A | 8/2007 | |
| KR | 100858147 | B1 | 9/2008 | |
| KR | 1020090005460 | A | 1/2009 | |
| KR | 20090119155 | A | 11/2009 | |
| KR | 102009011915 | A | 11/2009 | |
| KR | 20100041337 | A | 4/2010 | |
| KR | 1020110106051 | A | 9/2011 | |
| SU | 1567169 | A1 | 5/1990 | |
| WO | 8000783 | A1 | 5/1980 | |
| WO | 9603013A | A1 | 2/1996 | |
| WO | 9610349 | A1 | 4/1996 | |
| WO | 0111924 | A1 | 2/2001 | |
| WO | 0221967 | A1 | 3/2002 | |
| WO | 2004006712 | A1 | 1/2004 | |
| WO | WO-2007043732 | A1 * | 4/2007 | ..... A45D 20/12 |
| WO | WO 2007043732 | A1 * | 4/2007 | ..... A45D 20/12 |
| WO | 2007078048 | A1 | 7/2007 | |
| WO | 2008064075 | A2 | 5/2008 | |
| WO | 2009136739 | A2 | 11/2009 | |
| WO | 2012028862 | A1 | 3/2012 | |
| WO | WO-2012059700 | A2 | 5/2012 | |
| WO | 2012076885 | A2 | 6/2012 | |

OTHER PUBLICATIONS

British Search Report for corresponding application GB1212933.4 dated Feb. 21, 2013.
British Search Report for corresponding application GB1212933.4 dated Oct. 16, 2012.
British Search Report for corresponding application GB1214775.7; Report dated Apr. 18, 2013.
British Search Report for corresponding application GB1214775.7; Report dated Nov. 9, 2012.
British Search Report for corresponding application GB1214777.3 dated Nov. 13, 2012.
British Search Report for corresponding application GB1221671.9 dated Mar. 26, 2013.
British Search Report for corresponding application GB1306648.5 dated Sep. 19, 2013.
International Search Report for corresponding application PCT/GB2013/051636 filed Jun. 21, 2013; dated Nov. 7, 2013.
International Search Report for corresponding application PCT/GB2013/051648 filed Jun. 24, 2013; dated Jan. 17, 2014.
International Search Report for corresponding application PCT/GB2013/052188 filed Aug. 19, 2013; dated Dec. 18, 2013.
J.A. Curran, "Thermo-physical properties of plasma electrolytic oxide coatings on aluminium", Surface & Coatings Technology 199 (2005) 168-176.
Written Opinion for corresponding application PCT/GB2013/051636 filed Jun. 21, 2013; dated Nov. 7, 2013.
Written Opinion for corresponding application PCT/GB2013/051648 filed Jun. 24, 2013; dated Jan. 17, 2014.
Written Opinion for corresponding application PCT/GB2013/052188 filed Aug. 19, 2013; dated Dec. 18, 2013.
British Search Report for corresponding application GB1221674.3; Report dated Mar. 19, 2013.
International Search Report for corresponding application PCT/GB2013/053057 filed Nov. 20, 2013; dated Mar. 18, 2014.
Written Opinion for corresponding application PCT/GB2013/053057 filed Nov. 20, 2013; dated Mar. 18, 2014.
European Office Action for corresponding European Application 13 796 133.0; Report dated Aug. 18, 2016.
International Preliminary Report on Patentability for corresponding application PCT/GB2013/051636 filed Jun. 21, 2013; Report dated Dec. 31, 2014.
International Preliminary Report on Patentability for corresponding application PCT/GB2013/051648 filed Jun. 24, 2013; Report dated Dec. 31, 2014.
"Australian Application Serial No. 2013283014, First Examination Report dated Jun. 21, 2016", 2 pgs.
"Australian Application Serial No. 2013283014, Response filed Dec. 20, 2016 to First Examination Report dated Jun. 21, 2016", 18 pgs.
"Australian Application Serial No. 2016277577, First Examination Report dated Feb. 16, 2018", 4 pgs.
"Chinese Application Serial No. 201380033818.7, Argument and Amendment filed Jan. 25, 2017 in response to Office Action dated Aug. 23, 2016", (w/ English Translation of Argument), 33 pgs.
"Chinese Application Serial No. 201380033818.7, Argument and Amendment filed Aug. 9, 2017 in response to Office Action dated Jun. 15, 2017", (w/ English Translation of Argument), 11 pgs.
"Chinese Application Serial No. 201380033818.7, Office Action dated Jun. 15, 2017", (w/ English Translation), 8 pgs.
"Chinese Application Serial No. 201380033818.7, Office Action dated Aug. 23, 2016", (w/ English Translation), 31 pgs.
"European Application Serial No. 13731478.7, Intention to grant dated Feb. 13, 2017", 41 pgs.
"European Application Serial No. 13731478.7, Response filed May 28, 2015, to Communication pursuant to Rules 161(1) and 162 EPC dated Feb. 14, 2015", 20 pgs.
"United Kingdom Application Serial No. 1212933.4, Office Action dated Feb. 2, 2017", 4 pgs.
"United Kingdom Application Serial No. 1720073.4, Combined Search and Examination Report dated Jun. 30, 2018", 7 pgs.
"Chinese Application Serial No. 201810072096.0, Office Action dated Mar. 19, 2019", (Mar. 19, 2019), 8 pgs.
"U.S. Appl. No. 16/173,000, Preliminary Amendment filed Oct. 30, 2018", 5 pgs.
"GB1212933.4 Examination Report under Section 18(3)", (dated Feb. 2, 2017), 4 pages.
"GB1212933.4 Patent Rules 2007 Request to Make a Late Claim to Priority Under Rule 6(2)", (Jul. 15, 2013), 2 pages.
"GB1212933.4 Request for Examination and Amendments Filed Jun. 21, 2013", (dated Jun. 21, 2013), 15 pages.
"GB1212933.4 Response to Examination Report under Section 18(3)", (dated Mar. 30, 2017), 2 pages.
"GB1212933.4 Search Report under Section 17(5)", (dated Oct. 16, 2012), 5 pages.
"GB1212933.4 Search Report under Section 17(6) Part 1", (dated Feb. 21, 2013), 2 pages.
"GB1212933.4 Search Report under Section 17(6) Part 2", (dated Feb. 21, 2013), 2 pages.
"GB1212933.4 Search Report under Section 17(6) Part 3", (dated Feb. 21, 2013), 2 pages.
"GB1613699.6 Combined Search and Examination Report", (dated Feb. 6, 2017), 4 pages.
"GB1613699.6 Examination Report Jul. 3, 2017", (dated Jul. 3, 2017), 3 pages.
"GB1613699.6 Repsonse to Search and Examination Report", (dated Jun. 5, 2017), 1 page.

* cited by examiner

86

HAIR DRYER

FIELD OF THE INVENTION

The invention relates to hair dryers.

BACKGROUND TO THE INVENTION

A typical hand-held hair dryer comprises a hand-held housing with an air inlet, an air outlet, and a motor in between to draw air in from the air inlet and drive air out from the air outlet. A heating element is located in the air flow between the air inlet and the air outlet, typically after the motor in the air flow.

In some prior art hair dryers, a motor is coupled to a radial impeller to draw air in axially and generate a high air pressure by thrusting the air outwards. The fact that the air is confined by the housing means it is then forced through the hair dryer air outlet. The high pressure achieved by such a technique can be useful in forcing apart strands of hair. However, one downside is that a turbulent air stream can be produced meaning that although a hair pressure air flow is achieved, there is little control over the air flow. This invention addresses such issues and considers techniques for improving the flow of air within hand-held hair dryers.

Safety is also an important aspect in the design of such appliances—the presence of a heater element can be potentially dangerous if left to heat without appropriate dispersement of the heated air—there is a risk that it may overheat parts of the hair dryer or heater element. The invention further considers such issues.

Measures to reduce the weight of hair dryers are also considered. This can be particularly beneficial to professional hairdressers, and those at home, to avoid a user becoming tired of holding the hair dryer over extended periods of time.

SUMMARY OF THE INVENTION

According to one aspect of the invention there is provided a hair dryer comprising a housing having an air inlet and an air outlet, an air flow assembly for creating an air flow from the air inlet and to the air outlet such that the air flow is generally axial within the housing;

a heating element located in said air flow between the air inlet and to the air outlet; and a laminar element located between the heating element and the air outlet, the laminar element being arranged to compensate for any disturbance introduced into the axial air flow by the heating element whereby air flow from the air outlet is generally laminar.

A laminar flow occurs when a fluid, in this case air, flows in parallel layers with no disruption between the layers. As explained in more detail below, the arrangement of the components of the hair dryer allows a heated and laminar air flow to be produced and retained at a distance from the hair dryer. This means that the high pressure air output of conventional hair dryers is not needed (in conventional hair dryers the output air flow will disperse). The ability to focus the hot air stream means that the hot air is imparted into hair efficiently and leads to rapid hair dryer whilst also provided styling capabilities.

The air flow assembly may comprise a ducted axial impeller to provide an increased volumetric flow rate which leads to an improved uniform air flow compared to conventional radial impellers used on existing hair dryers. An axial impeller benefits the generation of a laminar air flow output by generating a generally uniform axial air. This uniform air flow is then driven through a laminar element positioned between the heating element and outlet to produce a laminar/streamline air flow without any cross currents or turbulence. This is particularly useful to aid in styling as a controllable, narrow stream of hot air is produced that allows a stylist to accurately position the generated air stream to improve hair styling.

The air flow assembly comprises an axial impeller driven by a motor. These components may be separate or may form an integrated fan and motor assembly. The integrated fan and motor assembly may comprise a motor concentrically mounted around a drive shaft and an axial impeller having a plurality of blades which extend radially around the motor and which are connected to the drive shaft to drive the blades. The motor may be a DC brushless motor.

In embodiments the integrated fan and motor assembly may further comprise a fan and a motor concentrically mounted about an axis of rotation of the fan, wherein the fan comprises an axial impeller having a plurality of blades which extend radially around the motor. The motor may further comprise a yoke and magnet coupled to the yoke. The magnet interacts with the stator assembly and rotates when driven by an electric current. The magnet is coupled to the yoke and the blades coupled (in some embodiments mounted directly) to the yoke. This removes the need for any further coupling from a drive shaft to a separate fan.

Thus according to another aspect of the invention, there is provided a hair dryer comprising a housing having an air inlet and an air outlet, an air flow assembly for creating an air flow from the air inlet and to the air outlet such that the air flow is generally axial within the housing;

a heating element located in said air flow between the air inlet and to the air outlet; wherein said air flow assembly is an integrated fan and motor assembly comprising a motor concentrically mounted around a drive shaft and an axial impeller having a plurality of blades which extend radially around the motor and which are connected to the drive shaft to drive the blades.

Such an integrated fan and motor assembly can be manufactured as a separate unit then easily inserted into the hair dryer housing. Said integrated fan and motor assembly may be housed within a ducting and at least a portion of the ducting may be cylindrical. The fact that the fan assembly has its own ducting means that the hair dryer housing may be formed into one or more different shapes without affecting the air flow through the heater air channel/outlet. A plurality of strakes may extend from an inner surface of the ducting whereby circular air currents within the housing of the hairdryer are reduced. Thus, the ducting can also contribute to ensure a laminar flow.

The laminar element may comprise array of elongate tubes.

According to another aspect of the invention there is provided a laminar element comprising an array of elongate tubes for insertion in an outlet of a hair dryer housing to produce a laminar air flow.

The array of tubes is positioned between the heating element and outlet to produce a laminar/streamline air flow without any cross currents or turbulence. This is particularly useful to aid in styling as a controllable, narrow stream of hot air is produced that allows a stylist to accurately position the generated air stream to improve hair styling.

At least a subset of said channels may have a matching cross-section in order uniformly form a laminar flow air stream. At least a subset of said channels may have a hexagonal cross section. In variants, at least a subset may have a square cross section or a circular cross section.

The array of tubes may be formed from silicone rubber, metal or plastic. Forming from silicone rubber may be particularly beneficial due to the poor thermal conductivity of silicone rubber meaning. This means the array of silicone rubber tubes heat up significantly less that metal and so reduces the risk of a user burning their head/hair. These tubes may have a length in the range of approximately 0.5 cm to 2 cm.

The array of tubes may be formed into a structure that appears like a mesh or grille when viewed face on. This structure may also be removable and/or interchangeable which may be desirable should a user require a more dispersed air flow.

The hair dryer may further comprise a nozzle having an inlet which matches the outlet of the hairdryer housing and an outlet having a generally rectangular cross-section. The nozzle may be shaped so that the cross-section of the nozzle changes gradually from the nozzle inlet to the nozzle outlet whereby disturbance to the air flow within the nozzle is minimised. The outlet is a generally planar/more flattened outlet providing an "airbrush", i.e. a generally flat air stream. The inlet has a cross-sectional area generally corresponding to the cross-sectional area of, what may be for example, a generally circular region of the hair dryer before the nozzle region. The outlet may have a cross-section which is generally of a similar area to that of the inlet but in practice the inlet is likely to be larger. As explained above, an axial impeller is used and thus reducing the air flow through the nozzle does not have an adverse effect on performance because of the low pressure of the air flow generated.

The outlet of the hair dryer housing may comprise a hot air outlet and a cool air outlet and the hair dryer housing may comprise a hot air channel through which air is drawn from the inlet past the heater to the hot air outlet and a cool air channel through which air is drawn from the inlet to the cool air outlet without passing the heater. The cool air channel may be in the form of an outer duct which circumscribes the hot air channel The cooler channel of air may have a plurality of strakes positioned at the exit of the air outlet and extending into the second air flow channel. These strakes control the cool air stream, minimise dispersement, may help to provide a laminar air flow and enable the cool air stream (when arranged such that the second air flow channel circumscribes the first air channel) to form a shroud around the heated air to further assist retaining a laminar air flow.

The second air channel may also extend forward of the first air channel which may be particularly useful for preventing the hair dryer outlet burning anything that it touches.

The outlets may preferably be arranged such that one circumscribes the other. The outlets may be arranged to emit the air streams such that the air streams emitted are generally concentric (i.e. emitted in the same direction) which minimises any mixing of the air streams. This minimises any interference between the hot and cool air streams and thus minimises turbulence and mixing between the hot and cool air. The effect of this is to emit a laminar air flow from at least the hot air outlet.

The first air flow channel provides heated air, the second a cool air channel, which, in some embodiments may circumscribe the hot (first) air flow channel. Where a nozzle is used, the first air flow channel and second air flow channel are extended into the nozzle. The nozzle may be arranged with the cool (second) outlet extending forward of the first (hot) air outlet which means that that the nozzle attachment can be placed very close to, or on the head of a person without burning their head whilst retaining a hot air stream that has been retained as a laminar air stream with minimal interaction with the cooler air. The second cool outlet may extend forward of the hot air outlet by 2 mm or more.

A laminar air flow is emitted from the hot air outlet (of both the hair dryer housing and/or the nozzle). The cooler air channel (of both the hair dryer housing and/or the nozzle) may, in some embodiments also be laminar. The fact that the cool air outlet is generally parallel to the heater air outlet means that the air streams are emitted in the same direction minimising dispersement of the heater air flow. The second outlet forms an annular-like stream of air shrouding the heated air produced from the first air outlet, assisting the heater air stream to retain a laminar flow. This contrasts with many existing hair dryers which mix the two air streams in the nozzle.

The first and second outlets may be arranged such that one circumscribes the other to generate substantially separate air streams, both focussed in the same direction to minimise any intermixing.

The second outlet may comprise a plurality of strakes extending into said air flow, said strakes being arranged to direct the flow of air out of said second outlet in order to provide a generally planer cool air flow to shroud the heated air from the first outlet.

The fan assembly may further comprise a motor controller mounted within the motor assembly configured to control said axial impeller. This controlling may include controlling the speed of the fan and include one or more levels of variable speed, such as off, full power, medium power, and one or more other intermediate levels. The DC motor used may be a brushless DC motor which is capable of delivering a high performance for its size. The brushless DC motor may be used to provide high power without increasing the size of the housing.

Such a controller may be mounted co-axially with said impeller in said motor assembly and may even be mounted directly onto the motor, avoiding the need to place the controller anywhere else in the housing. It also means that the fan assembly unit can be manufactured and tested separately to the remaining components of the hair dryer.

In embodiments the heater will be powered by an AC power source and the DC motor will accordingly require a DC power source, thus the hair dryer may further comprise a power supply unit comprising an AC to DC converter for driving at least the DC motor. Such a power supply unit may be external to the hand-held housing to avoid housing the power supply unit (which may include a switched mode power supply) in the portion of the hair dryer held by a user. Both AC and DC power may then be delivered to the hand-held housing portion of the hair dryer by a power cord.

To reduce weight of the power cord extending from the power supply unit to the hair dyer housing, the power supply unit may be configured to deliver both an AC supply and a DC supply to the hand-held housing by combining one or more signal rails of each of the AC and DC supply. This means that, rather than a four core cable being used (live and neutral for the AC, and positive and negative (or 0V) rail for the DC) one of these rails may be shared allowing a conventional three core cable to be used.

A neutral signal rail of the AC supply may be coupled to one of the DC signal rails—in particular the V−/0V rail to provide a shared neutral power rail and allow a three core cable to be used.

The hair dryer, (preferably the power supply) may further comprise a controller configured to sense activation of said DC motor such that responsive to detecting activation the hair dryer is configured to power the heating element. In other words, the controller may prevent AC power being supplied to the heater until a DC current is detected/sensed as being delivered to rotate the fan and thus prevent the hair dryer housing overheating.

As a safety measure, the hair dryer may only allow mains AC voltage to be passed to the dryer only if the fan motor is turning. This ensures that air is been blown at force past the heater element before power is supplied to the heater. Without the fan on, the heater may get too hot and become a safety hazard. The power supply senses if the fan motor is on by sensing a current being drawn from the DC (for example +12V DC) line.

By sensing the motor current, electronics within the power supply then turn on a mechanical relay. The inclusion of a relay-switched live connection provides an important safety improvement over traditional dryers.

In order to improve air flow the fan assembly may further comprise a nose cone mounted co-axially with said impeller in the fan assembly which helps to guide air towards the fan axis and retain the uniform air flow.

According to another aspect of the invention there is provided a hair dryer having a hand-held housing comprising: an air inlet and an air outlet; a motor assembly between said air inlet and said air outlet to draw air in from said air inlet and drive air out from said air outlet, wherein said motor assembly comprises a DC powered motor; a heating element located in said air flow between said air inlet and said air outlet; and a control circuit configured to activate said heating element responsive to sensing activation of said DC powered motor.

Conventionally, hair dryers include a thermal cutout (such as a bimetallic thermal cutout) to disable power in the event of the hair dryer overheating. Such overheating may be caused by a failure of the motor/fan circuit for example meaning that the heating element is heating up static air rather than air flowing over it.

With the inclusion of both DC and AC powered components, the present invention provides features for further improving safety measures by sensing the motor current. The controller/power supply unit may then activate the heater (and any other AC powered components) in response to sensing the delivery of dc current to the dc fan/motor. The heater may then be powered by activating a relay for example to enable a switched live connection.

This relay-switched live connection provides an important safety improvement over traditional dryers as it prevents the heater being turned on without any air flow being produced.

Such sensing may comprise using a current sensor (for example a current sense resistor) to sense activation of the DC powered motor. Delivery of AC power may then comprise using a relay positioned between a power source and the powered heating element which is activated by the controller in response to sensing delivery of a current to the DC motor. A particular advantage of this is that the DC sensing and AC relay can be implemented in a power supply external to the hair dryer, close to where power conversion (AC to DC) is taking place. This means that power can be completely removed from the hair dryer hand-held housing further increasing safety.

In another variant an optical sensor may be positioned in the hand-held housing used to detect rotation of the fan. When no (or insufficient) rotation is occurring, the controller may then prevent activation of the ac relay.

The relay may be activated by a transistor switch coupled to the relay. A protection diode may be connected across the relay to protect the transistor from any current spike generated as the relay is turned off.

According to another aspect of the invention there is provided a hair dryer nozzle comprising a nozzle housing having a first and second nozzle inlet and a first and second nozzle outlet, a first air flow channel between said first air inlet and said first air outlet and a second air flow channel between said second air inlet and said second air outlet;

wherein said second air outlet at least substantially circumscribes said first air outlet, wherein said first air inlet is substantially circular and said first air outlet is substantially rectangular.

Strakes may be provided in the second outlet circumscribing the first outlet to control the air flow exiting the nozzle. When coupled to a hair dryer the first outlet may typically received a heated air stream and the outer circumscribing second air channel typically receives a cool are stream (from air not directly passing over a heater element). These strakes may assist in controlling the air flow such that the cool air stream is emitted in the same direction as the heated air stream emitted from the first air outlet, thus minimising introduction of turbulence. This can be particularly useful for shrouding any airflow produces from the inner first air stream and assists in preventing any separation/dispersement of this inner air stream.

The cross-sectional area of the inlets relative to the outlets may be preserved. By preserving the cross-sectional area, any change to the characteristic of the air flow (in particular through the interior first air flow channel) may be minimised and thus any laminar flow effect in the air stream received at the inlets is retained. The shape change may be gradual and provided by interior curved walls in order to minimise any turbulence to air flowing through one or both of the channels.

According to another aspect of the invention there is provided a hair dryer comprising the nozzle according to the aspect as described immediately hereinbefore of the invention. Such a nozzle may be detachable from the hair dryer or permanently fixed. The nozzle may even form part of the hair dryer housing.

We also describe a hair styling appliance having a hand-held housing comprising hair styling means, wherein said hair styling appliance comprises a power supply unit external to said hand-held housing configured to generate a DC power supply from an AC input and configured to deliver both an AC power supply and said DC power supply to said hand-held housing, and wherein said power supply unit is configured to deliver said AC supply and said DC supply by combining one or more signal rails of each of said AC and DC supply.

The number of power signal lines is reduced four to three by sharing a signal line. This provides a reduction in weight of the power cord (which may be up to 25% weight reduction) extending from the power supply unit to the hair dyer housing whilst still allowing the power supply unit deliver both an AC supply and a DC supply to the hand-held housing. This is achieved by combining one or more signal rails of each of the AC and DC supply. This means that, rather than a four core cable being used (live and neutral for the AC, and positive and negative (or 0V) rail for the DC) one of these rails may be shared allowing a conventional three core cable to be used.

The neutral signal rail of the AC supply may be coupled to one of the DC signal rails, in particular the V−/0V rail to provide a shared neutral power rail.

One or more of the features described in embodiments of the above aspects may be interchangeable and applicable to other embodiments.

BRIEF DESCRIPTION OF THE DRAWINGS

For a better understanding of the invention and to show how it may be carried into effect reference shall now be made, by way of example only, to the accompanying drawings in which.

DETAILED DESCRIPTION OF THE PREFERRED EMBODIMENTS

Figure 12A:
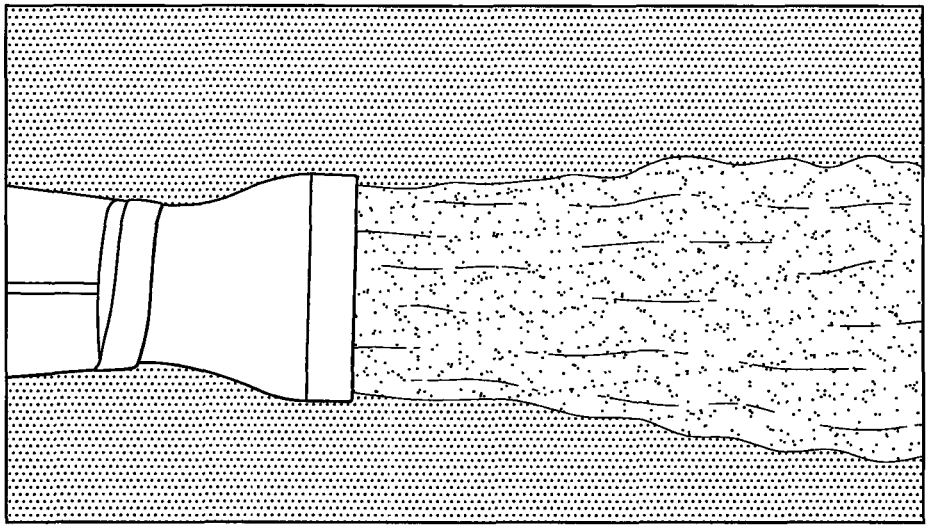
FIG. 12*a* shows a smoke diagram of laminar flow air output from the hairdryer of FIG. 1.
Figure 12B:
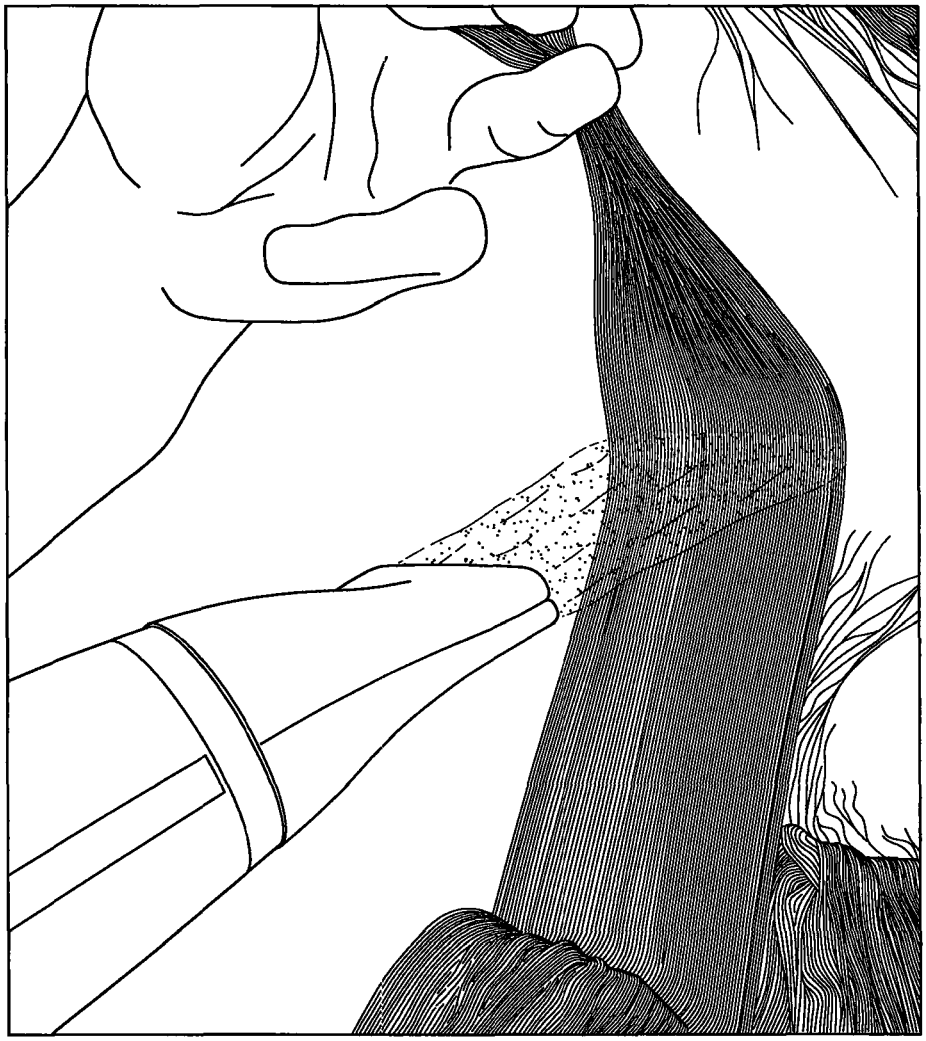
FIG. 12*b* shows the laminar flow output being used to style hair.

FIGS. 1 to 7*b* show a hair dryer 10 with a nozzle 20 coupled thereto. As explained in more detail below, the various components of the hair dryer, including the nozzle attachment, cooperate to ensure that the output from the hair dryer is generally in the form of a laminar flow. A laminar flow (streamline flow) occurs when a fluid, in this case air, flows in parallel layers with no disruption between the layers. This substantially reduces any form of fluid swirling and lateral mixing leading to minimal turbulence. As shown in FIG. 12*a*, the arrangement of all the components means that the laminar flow is retained for up to 20 to 30 cm from the nozzle. As shown in FIG. 12*b*, the nozzle attachment 20 provides a focussed stream of air which allows the hairdryer to be used as an "airbrush".

Figure 1:
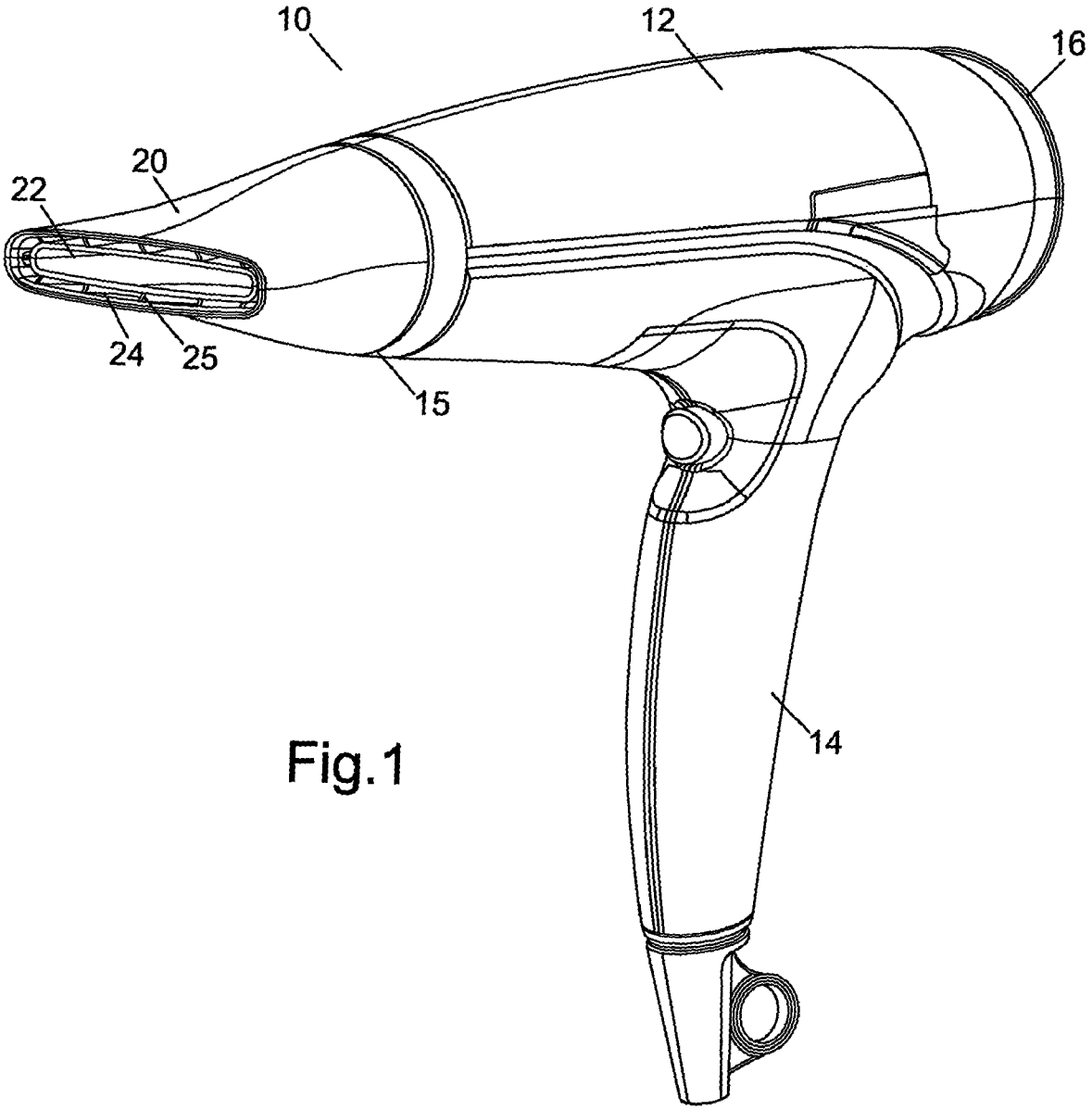
FIG. 1 shows a hair dryer with nozzle attachment.
Figure 2:
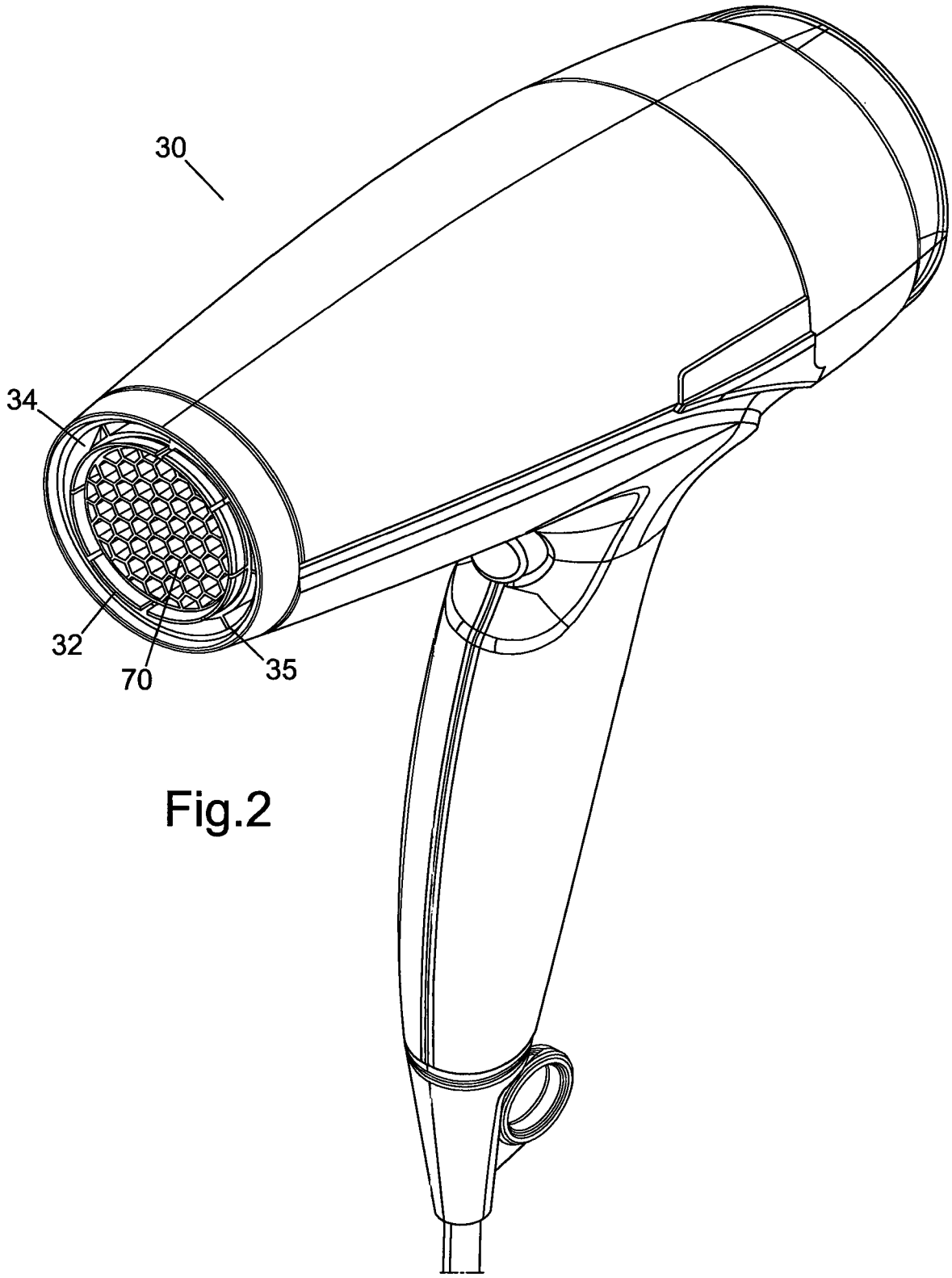
FIG. 2 shows the hair dryer of FIG. 1 without a nozzle attachment.
Figure 3A:
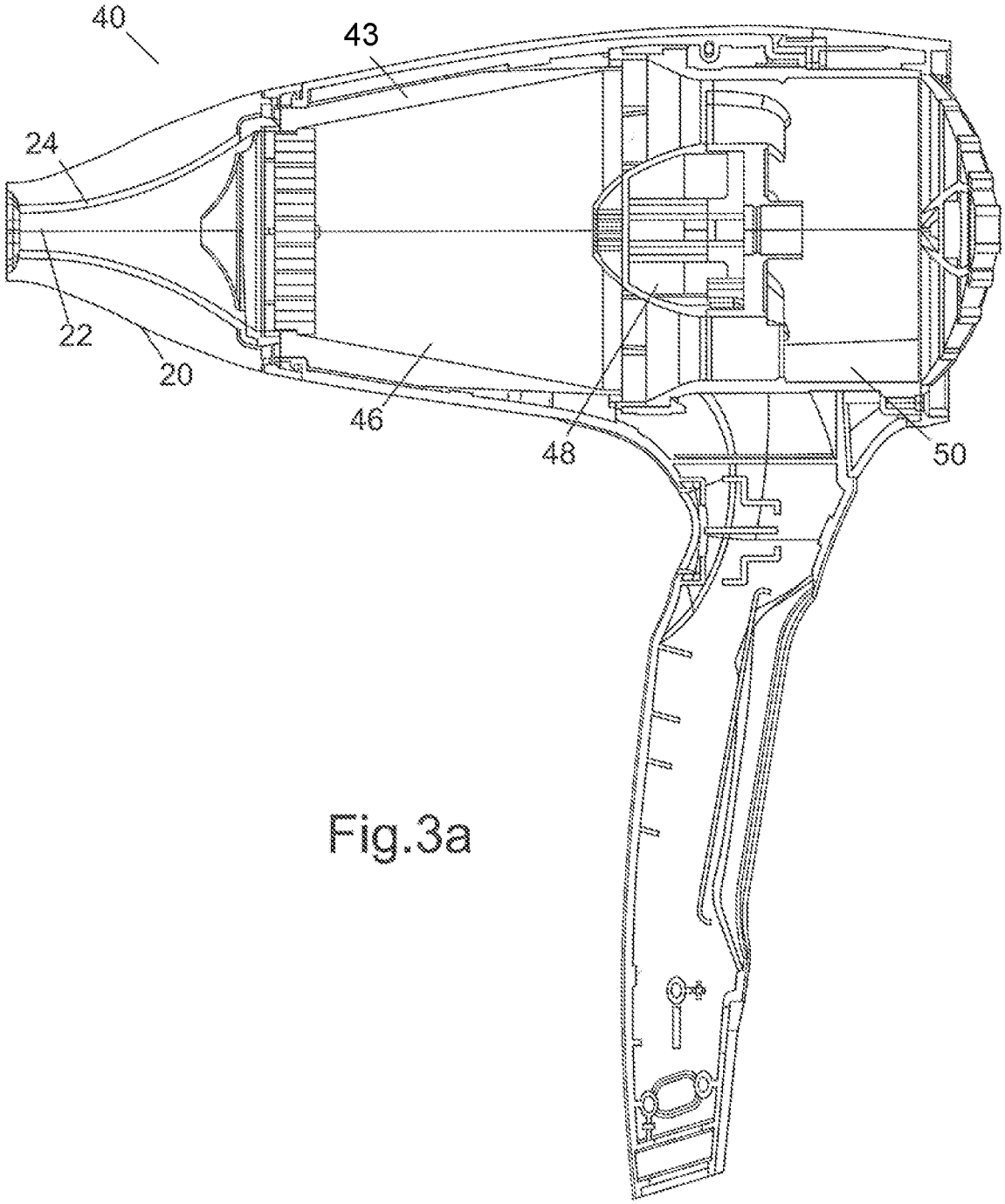
FIG. 3*a* shows a cross section of the hair dryer of FIG. 1.
Figure 3B:
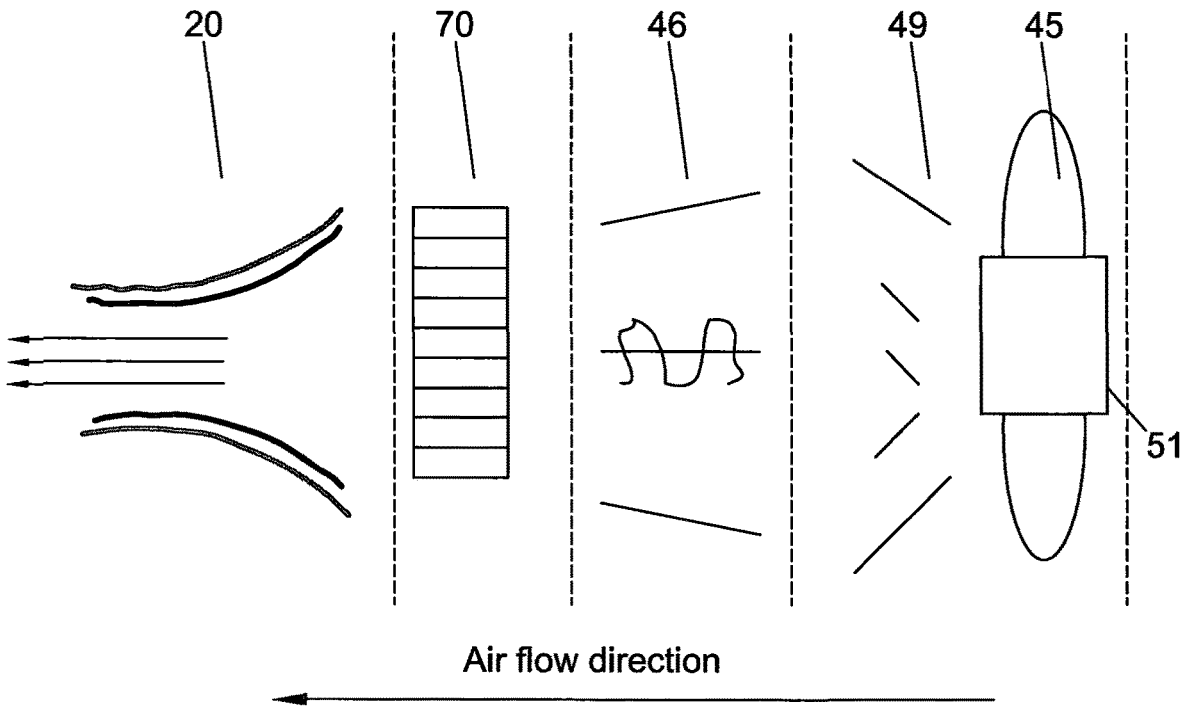
FIG. 3*b* shows a schematic view of the components of the hair dryer of FIG. 1.

The hair dryer comprises a casing (or housing) 12 having an inlet end 16 protected by a finger guard and an outlet end 15 to which the nozzle attachment 20 is releasably coupled. In line with standard hairdryers, a handle 14 extends from the casing 12 to allow a user to hold the hairdryer. As shown in FIGS. 3*a* and 3*b*, the casing houses an integrated fan/motor assembly 50 for creating air flow through the hairdryer from the inlet end and to the outlet end. Positioned on the front of the fan assembly is a nose cone 48 and in front of the fan assembly 50 is a heater 46 to heat air which comes into contact with the heater 46. A laminar element 70 is positioned at the outlet end and is described in more detail in relation to FIGS. 6*a* and 6*b*.

There are two airflow channels within the casing. It will be appreciated that this is an optional feature and that is possible to provide a laminar flow for a single hot air stream would also work.

Both channels draw air through the inlet with a first airflow channel outputting hot air through an inner outlet 34 and a second airflow channel outputting unheated air through an outer outlet 34. The first airflow channel passes through the heater 46 and is thus generally centrally located within the casing. The second airflow channel comprises an outer duct 43 which circumscribes the heater 46. The air flow along the second airflow channel does not contact the heater and thus maintained at approximately room temperature. Accordingly, the second airflow channel acts as an insulator and minimises the transfer of heat from the heater to the outer housing of the wall. As shown more clearly in FIG. 2, the cool air channel outlet 34 of the hair dryer extends forwards of the inner hot air channel outlet 32. A plurality of air strakes 35 are positioned in the cool air channel, at least around the cool air channel outlet 34. The strakes 35 are generally planar projections extending from, and at an angle to, the exterior surface of the inner air channel. The strakes 35 help to control the exit flow of cool air and also maintain the structural integrity of the cool air channel.

The separation of hot and cold (unheated) air continues in the nozzle 20. A cool air channel 24 extends through the nozzle and aligns with the cool air duct/channel 43 in the hair dryer body. A hot air channel 22 extends through the nozzle and aligns with the first airflow channel passing through the heater 46. The nozzle attachment 20 thus has two channels of air flow. The first inner channel 22 provides a hot air outlet and surrounding the hot air channel 24 is a cool air channel which provides a cool air outlet.

Figure 7A:
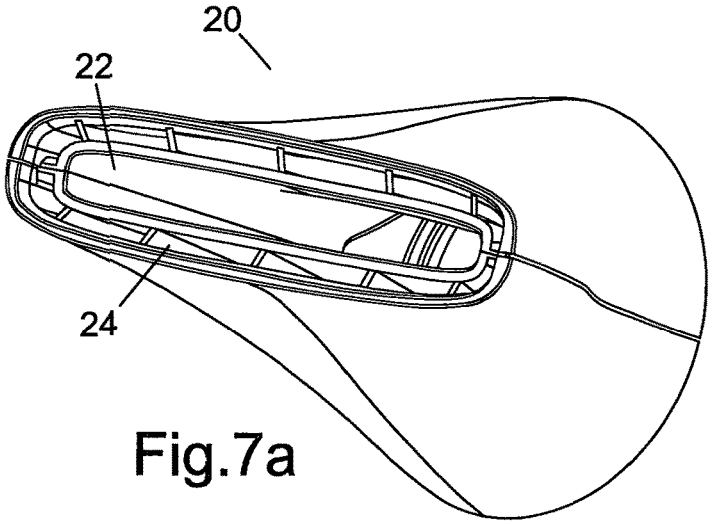
FIGS. 7*a* and 7*b* show details of the nozzle attachment shown in FIG. 1.

As can be seen in FIG. 7*a*, the cool air channel outlet extends forwards of the inner hot air channel outlet. Extending the cool air channel allows the hairdryer (with or without nozzle attachment) to be placed close to a user's head without burning their head. Furthermore, if the hair dryer is accidently left with the outlet in contact with a carpet or other object, the cool air channel prevents any burn damage. The cool air outlet may extend forward of the hot air outlet by a few millimetres (2 mm or more for example)—both on the hair dryer and on the nozzle.

It is noted that allow the cool air outlet in the nozzle extends beyond the hot air outlet in the nozzle, there is little or no mixing of the two air flows within the nozzle. As explained above, the laminar flow produced by the hairdryer extends for upto 20 cm and the extension of the cool air outlet is not sufficient to disrupt this flow.

The nozzle 20 is detachable allowing a stylist to select from one of a range of different nozzles. It will be appreciated however that in some variants the nozzle may be secured to the hair dryer and non-removable.

Figure 4:
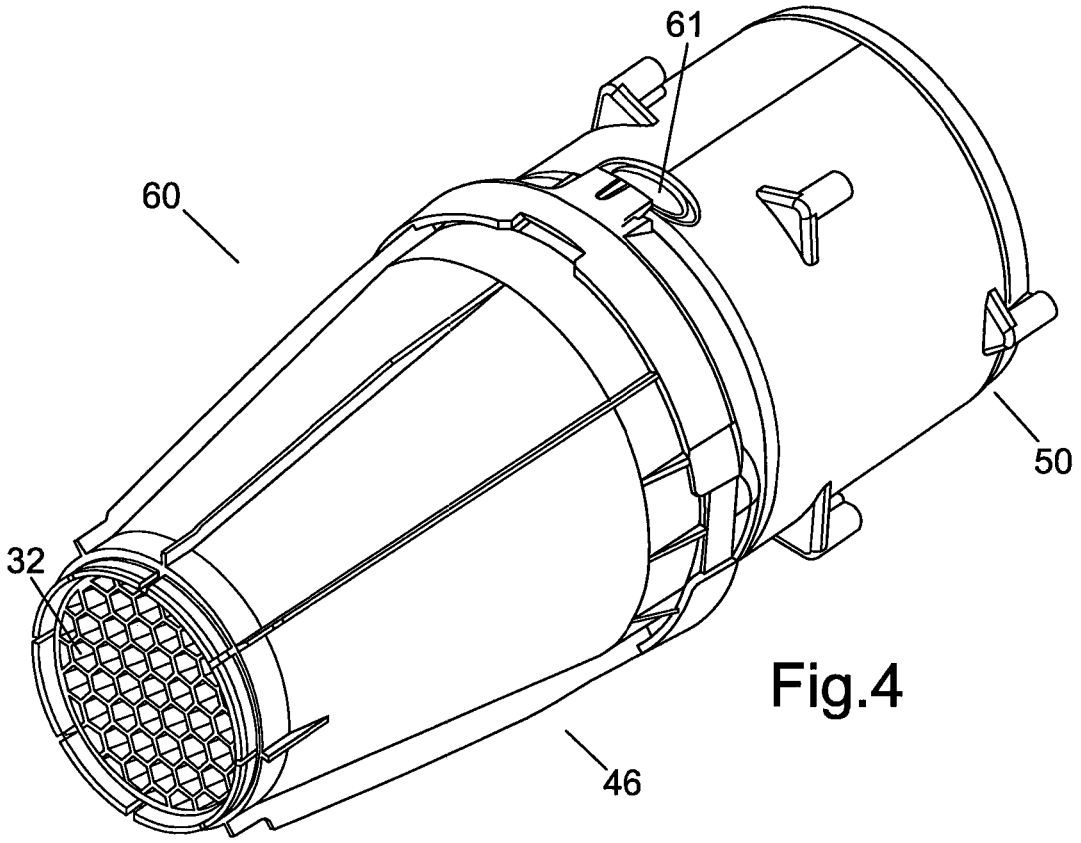
FIG. 4 shows a perspective view of the integral heater and fan assembly of the hair dryer of FIG. 1.

FIG. 4 shows the heater unit 46 and integrated fan and motor assembly 50. The two parts snap fit together to form a combined unit 60 via a series of retaining clips 61. The hot air channel is defined as the channel within this combined unit. The heater unit comprises a heater element (not shown) positioned inside the heater unit to heat air as it passes over the heater element. Such heater elements may have any standard design. As schematically drawn in FIG. 3*b*, the heater unit may comprise a plurality of planar supports which are approximately axially aligned and which support a heating element in the form of a wire.

Figure 5:
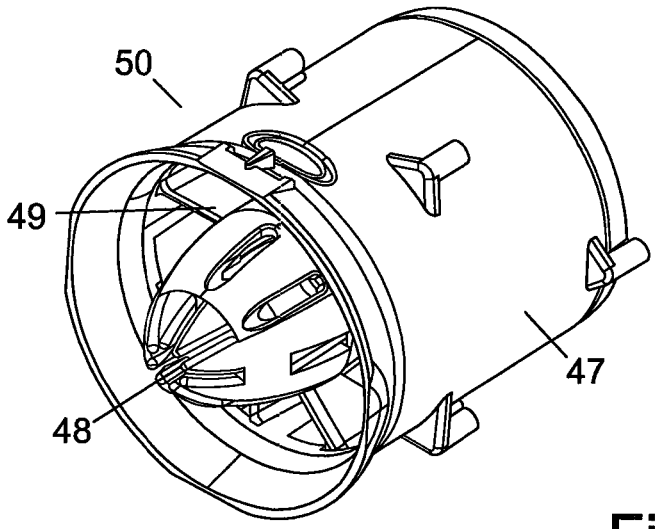
FIG. 5 shows a perspective view of the integral fan/motor assembly of FIG. 4.

FIG. 5 shows the integrated fan/motor assembly 50. As schematically drawn in FIG. 3*b*, the assembly comprises a fan 45 and a motor 51 housed within a generally cylindrical housing 47 to form a ducted axial impeller fan. Air is drawn through the inlet and forced through the housing 47 in an axial direction. A conventional axial flow fan generally comprises a cylindrical central hub section, a plurality of blades extending radially from the central hub section and a housing encasing the blades. A driving motor is attached to the hub section via a motor shaft to drive the fan into rotation. Such a conventional arrangement may be used in the present application. However, the arrangement of FIG. 5 and FIGS. 13*a-d* is an integrated fan/motor assembly which removes the need for a separate motor connected by a drive shaft to a separate fan. As shown in FIGS. 13*a-d*, this is achieved by mounting the fan blades 45 so that they extend radially from around the motor components themselves and by concentrically mounting the components of the motor around an axis of rotation of the fan. One example of an integrated fan/motor assembly is described in U.S. Pat. No. 6,457,953 and related applications which are incorporated by reference.

Figure 13A:
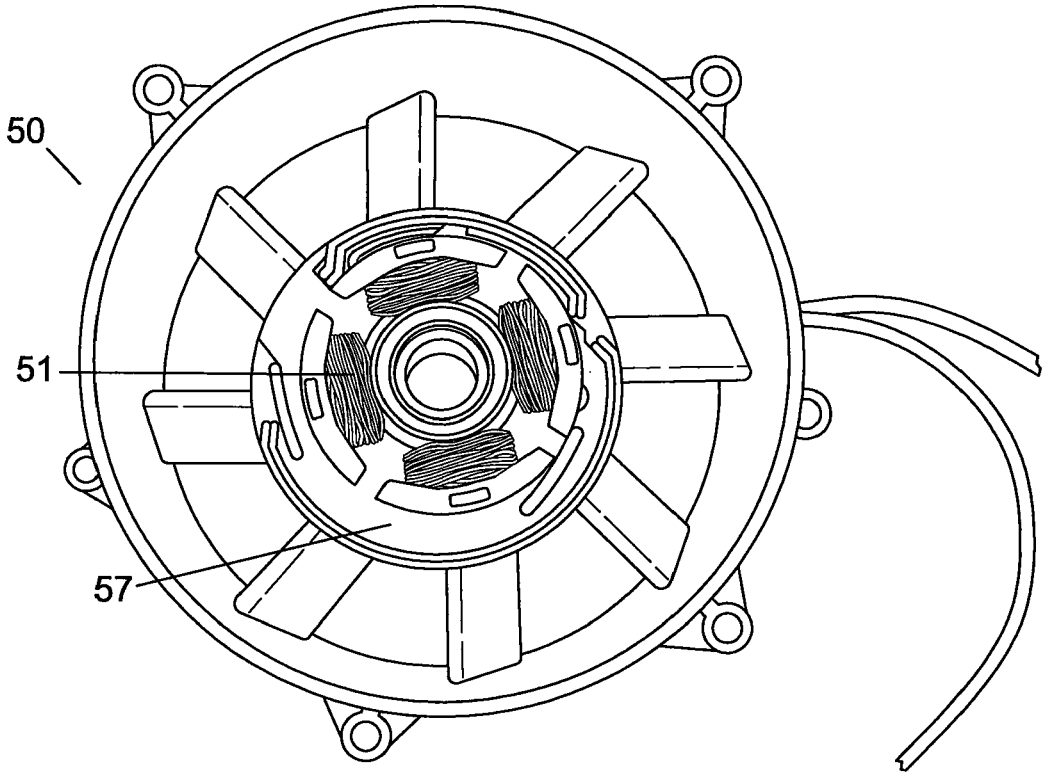
FIGS. 13*a* to 13*d* shows further details of the integral fan/motor assembly of FIG. 5.
Figure 13B:
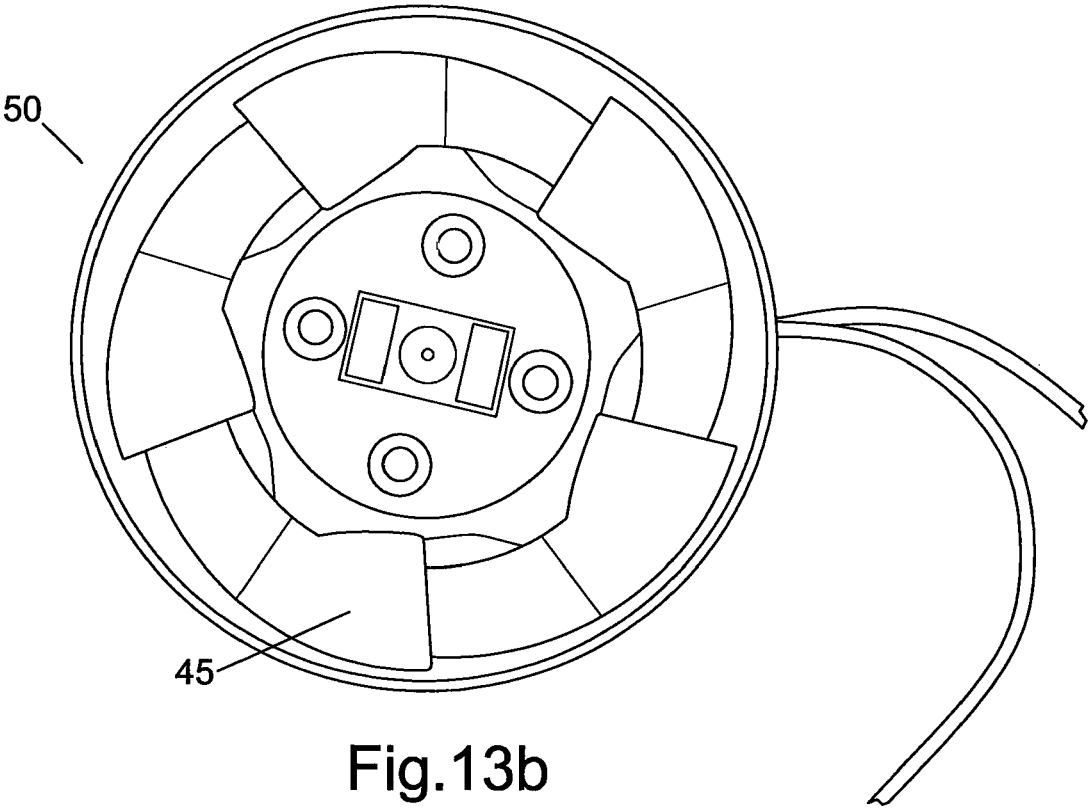
Figure 13C:
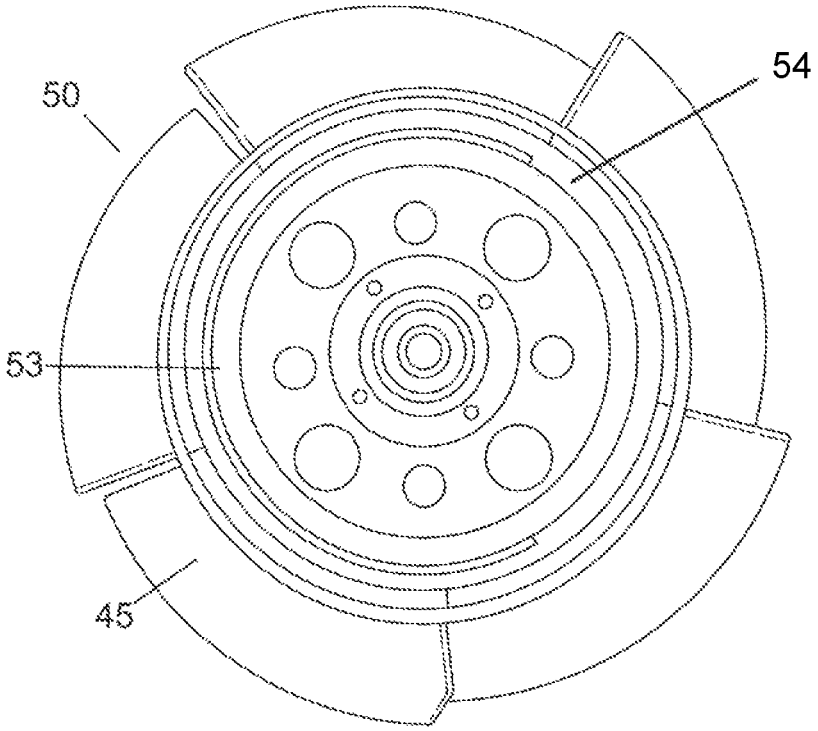

The motor 51 is preferably a brushless DC motor as depicted in FIG. 13*a*. In other words, the motor 51 preferably comprises a coil subassembly and rotating permanent magnets 53 (as shown in FIG. 13*c*) and a fixed armature (stator). The magnets 53 are bonded onto the yoke 54 which also forms the casing onto which the fan blades are directly mounted. This arrangement eliminates the need for coupling the motor to a separate fan via a drive shaft. An electronic controller 57 replaces the brush assembly of a brushed DC motor and the electronic controller ensures that the motor keeps turning. A brushless motor typically is compact and high powered delivering a high rotation speed compared to a conventional AC motor.

A motor and motor controller 57 are positioned on the axis of the fan within the fan assembly to control the speed of rotation of the fan. This may include, for example, "off", "medium speed", "full speed" although it will be appreciated that may intermediate speed levels may also be provided.

Figure 13D:
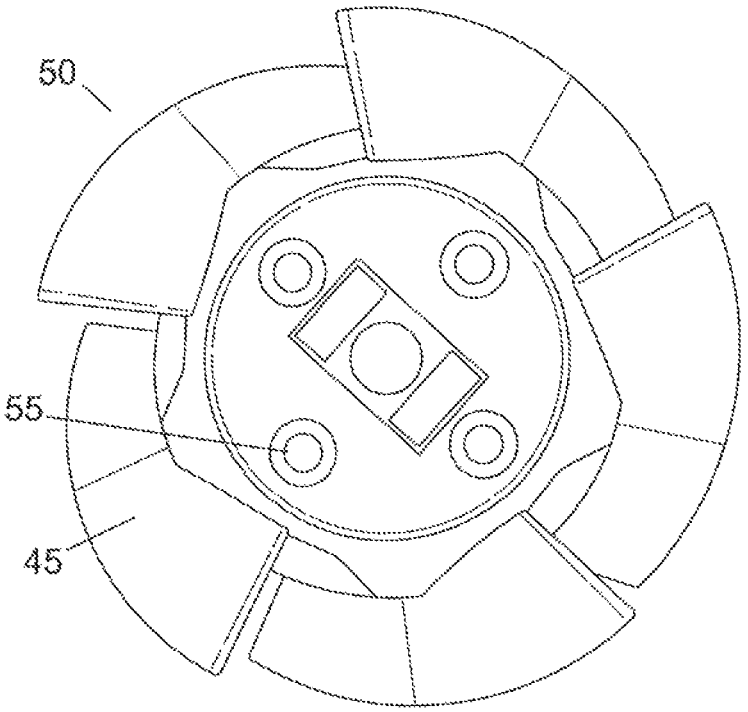

Referring now to FIG. 13*d*, the fan assembly also includes air vent holes 55 positioned between the blades of the fan. These vent holes allow cooling of the motor and controller and prevent overheating. The fan blades may be arranged such that they force a quantity of air through these holes to improve cooling.

The presence of a fast rotating axial impeller within the duct provides a high volumetric flow rate. Moreover, the air flow is generally uniform and is generally an axial flow. As schematically illustrated in FIG. 3*a*, the cylindrical housing 47 further comprises a plurality of stators 49 which are generally planar projections extending from, and at an angle to, the interior surface of the housing. Any generated circular air currents are removed by the stators 49 resulting in a generally laminar air flow being emitted from the integrated fan and motor assembly.

The central axial motor creates a dead spot in the resultant flow. As shown in FIG. 5, a nose cone 48 is centrally mounted on the front of the integrated motor/fan assembly which helps to guide air towards the fan axis and ensure a uniform air flow across the entire cross-section.

The air flow is generally laminar as it exits the integrated motor/fan assembly. As shown in FIG. 3*b*, the air in the first air channel passes over the heater element in the heater unit 46. To counteract any turbulence introduced in the heated air from the heater element, a laminar element 70 is positioned in the hot air channel outlet 32. The laminar element comprises a plurality of tubes which are aligned with each other to produce a laminar flow output of hot air.

Figure 6A:
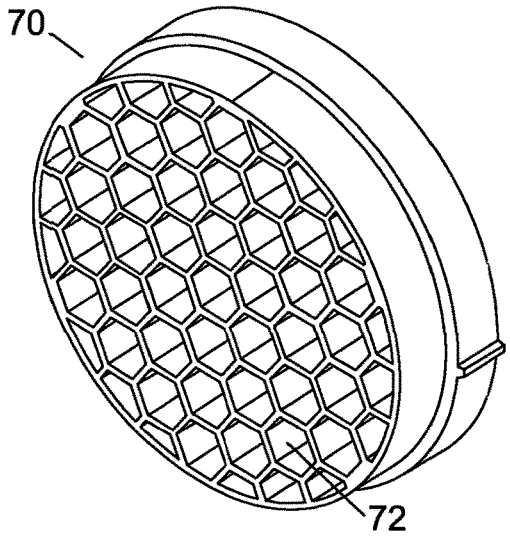
FIGS. 6*a* and 6*b* show details of the laminar element of the hair dryer of FIG. 1.
Figure 6B:
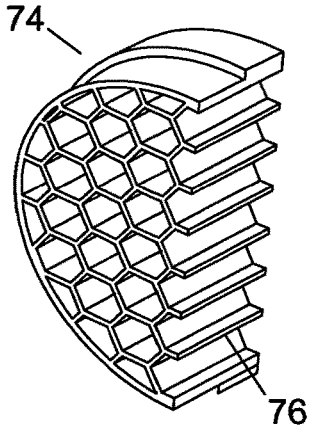

FIGS. 6*a* and 6*b* show the details of the laminar element 70. The laminar element comprises an array of tubes 76 (or elongate channels) which are all axially aligned with each other. The axial alignment of the channel forces air entering the array into a laminar air flow. The axes are generally aligned perpendicular to the plane of the outlet whereby the laminar air flow is generally perpendicular to the axis of the hairdryer housing. The laminar air flow may be arranged at a different angle to the axis of the hairdryer if desired.

In the example shown, the tubes have a hexagonal cross-section. Tubes having other cross-sectional shapes may be used and a mixture of shapes may be used. However, the array should have minimal dead space between the tubes because such dead space will block air flow. Rectangular or square cross-sectional shapes also have minimal dead space but these have sharp corners which increase turbulence. Circular cross-sectional shapes are the optimum for preventing turbulence but clearly result in dead space. The hexagonal arrangement provides a reasonable comprise between reducing sharp corners within the tubes and reducing the waste space between tubes.

Other arrangements may provide the same benefit, including. a mixture of shapes to maximise tessellation and minimise corners. However, the hexagonal arrangement is likely to be easier to manufacture than such a composite arrangement, e.g. by processes such as injection moulding.

The laminar element may be manufactured from metal, plastic or silicone rubber. Silicone rubber is particularly useful as it is tolerant to a wide range of temperatures and does not get as hot to the touch as a metal, meaning that it is safer to use. Furthermore, this also means the laminar element may not need a guard in front or need to be recessed into the hair dryer, i.e. it can be positioned close to the outlet. The laminar element may also be removably mounted within the casing.

The air flow is generally laminar as it exits the laminar element and flows into the inner channel of the nozzle (if one is attached). The nozzle attachment 20 is shaped to retain this uniform air flow whilst also minimising turbulence. The simplest way to achieve this would be to match the nozzle outlet to the shape of the outlet of the casing. However, this would result in an air flow having a generally circular cross-section which is not very useful for styling. Accordingly, the nozzle has an outlet which is the form of a generally elongate rectangle with curved edges (or flattened ellipse) and thus resembles an "air-brush". The elongate outlet forms a "blade" of air for styling.

Figure 7B:
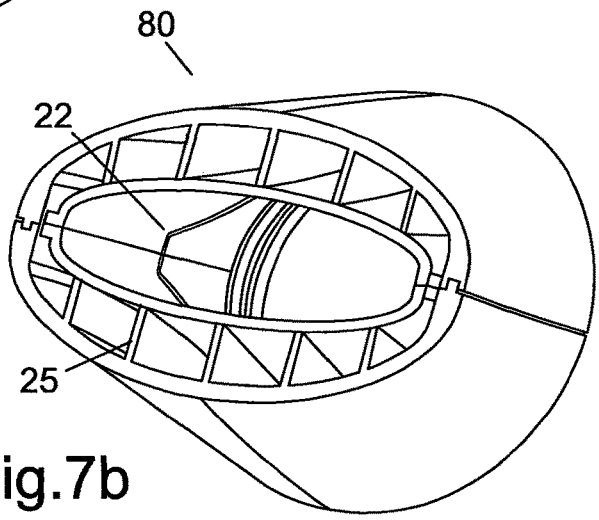

As shown in FIGS. 7*a* and 7*b*, the nozzle has a hot air channel inlet which is generally circular and which matches the hot air channel outlet from the hair dryer. The nozzle has a cool air channel inlet which is annular and which matches the hot air channel outlet from the hair dryer. The nozzle is shaped to change gradually from a substantially circular inlet to a generally rectangular outlet to minimise turbulence within the hot and cool air flow channels. This is achieved by using curved surfaces with no sharp angles or step changes.

As shown in FIG. 7*b*, a series of air strakes 25 are positioned within the cool air channel 24 which may help to guide and control the cool air flow through and out of the nozzle. The strakes 25 may also help maintain the structural integrity of the cool air channel. In use, the cool air channel provides a cool air 'shroud' around the stream of hot air output from the nozzle which further limits any dispersement of the hot air stream providing a controllable narrow stream of hot air providing in effect an 'air brush'.

As described above, the fan assembly, heater unit, laminar element and nozzle all cooperate to ensure that the air output, particularly the hot air output is a laminar flow. It will be appreciated that each of these elements may be used alone or in combination. Without all co-operating elements, it is possible that a laminar flow as shown in FIG. 12*b* may not be achieved but a reasonable compromise between cost, effectiveness and manufacturing issues may be achieved.

FIGS. 8 to 11 show a hairdryer which has an external power supply unit to reduce the weight of the hair dryer. It will be appreciated that this embodiment may be combined with the previous embodiment for producing a laminar airflow. In FIGS. 8 to 11, the hair dryer 90 comprises a hair dryer hand-held housing 10 (or any other variant as previously described) connected via power cable 42 to a power supply unit 44. The power supply unit is connected to mains power via plug 46. The power supply delivers both AC and DC power to the hair dryer body via a three core cable 42. AC power is used to power the heating elements and DC power to drive the DC brushless motor in the integrated fan and motor assembly.

Figure 8:
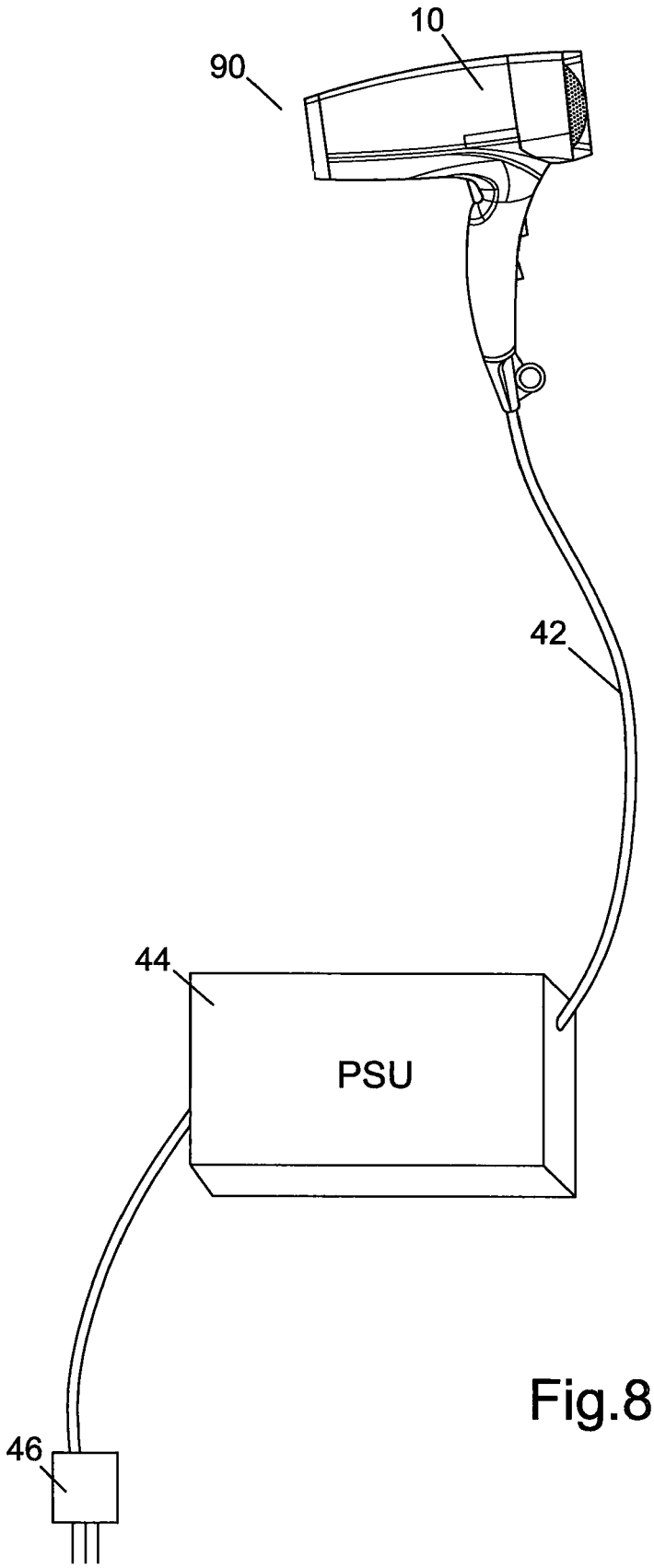
FIG. 8 shows a hair dryer with external power supply unit.
Figure 9:
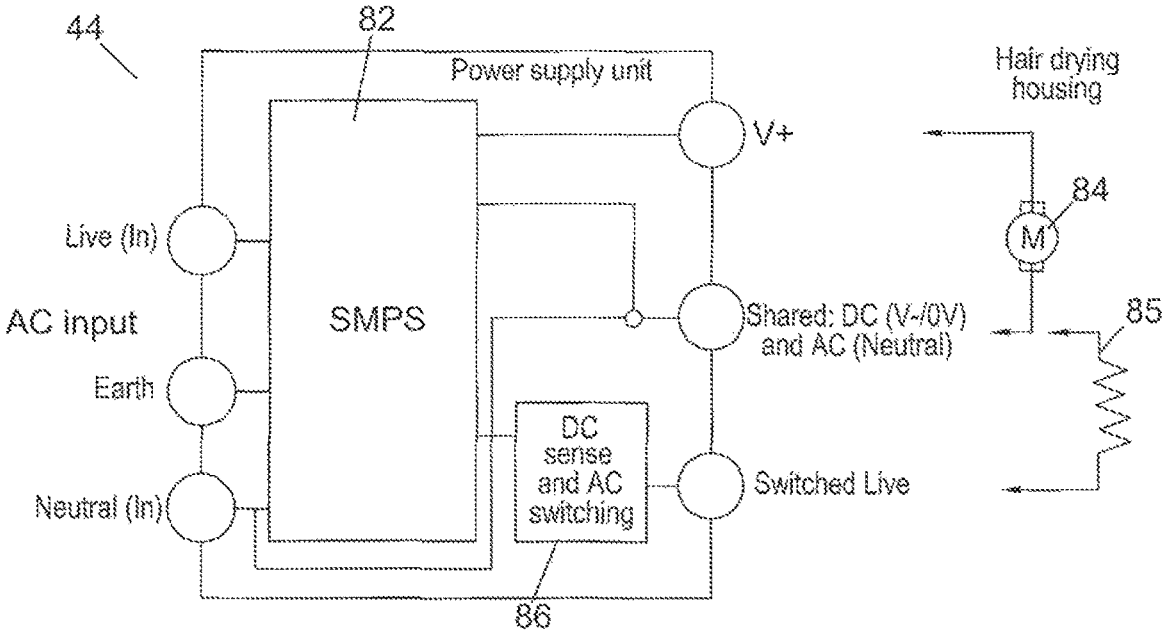
FIG. 9 shows a block diagram of the external power supply unit of FIG. 8.

FIG. 9 shows a block diagram of the external power supply unit 44 of FIG. 8. The power supply comprises an AC input and switched mode power supply (SMPS) 82. An AC relay circuit (control circuit) 86 is used to control AC power delivery to the heater element 85 only when the DC motor driven fan 84 is activated. This provides a safety measure to ensures the heater element is not activated without a flow of air, thus preventing overheating. The AC (neutral) and DC (V−/0V) rail are combined at the output of the power supply unit. This eliminates the need for a four core cable, meaning a lighter, conventional three core cable can be used to deliver both AC and DC power to the hair dryer from the external power supply.

Figure 10:
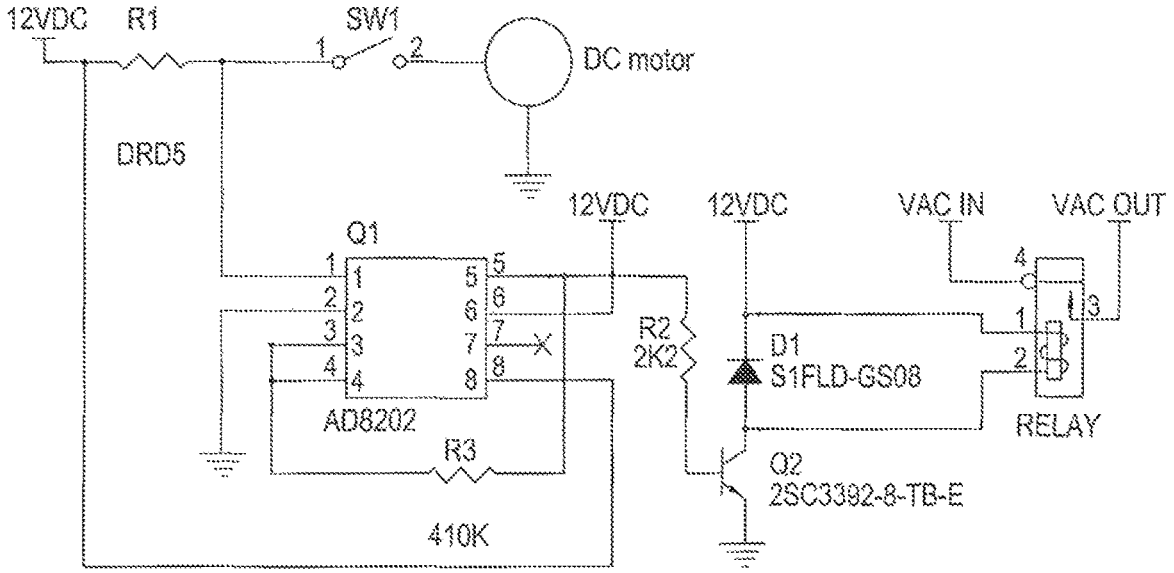
FIG. 10 shows an example of an AC power switching circuit for the heater.

FIG. 10 shows an example schematic of the control circuit 86 used to control power delivery to the heater element. The circuit 86 is configured to only deliver power to the heater when the DC fan is activated to avoid the risk of the hair dryer overheating. Resistor R1 acts as a current sense, to providing a current sense signal to Q1 on the closing of SW1 (which activates the DC motor). Transistor Q2 is driven into saturation so that majority of the 12V is DC supply is supplied across the motor relay. Diode D1 is connected in reverse across the relay as a snub to protect the transistor from any current spike generated as the relay switches off.

Figure 11:
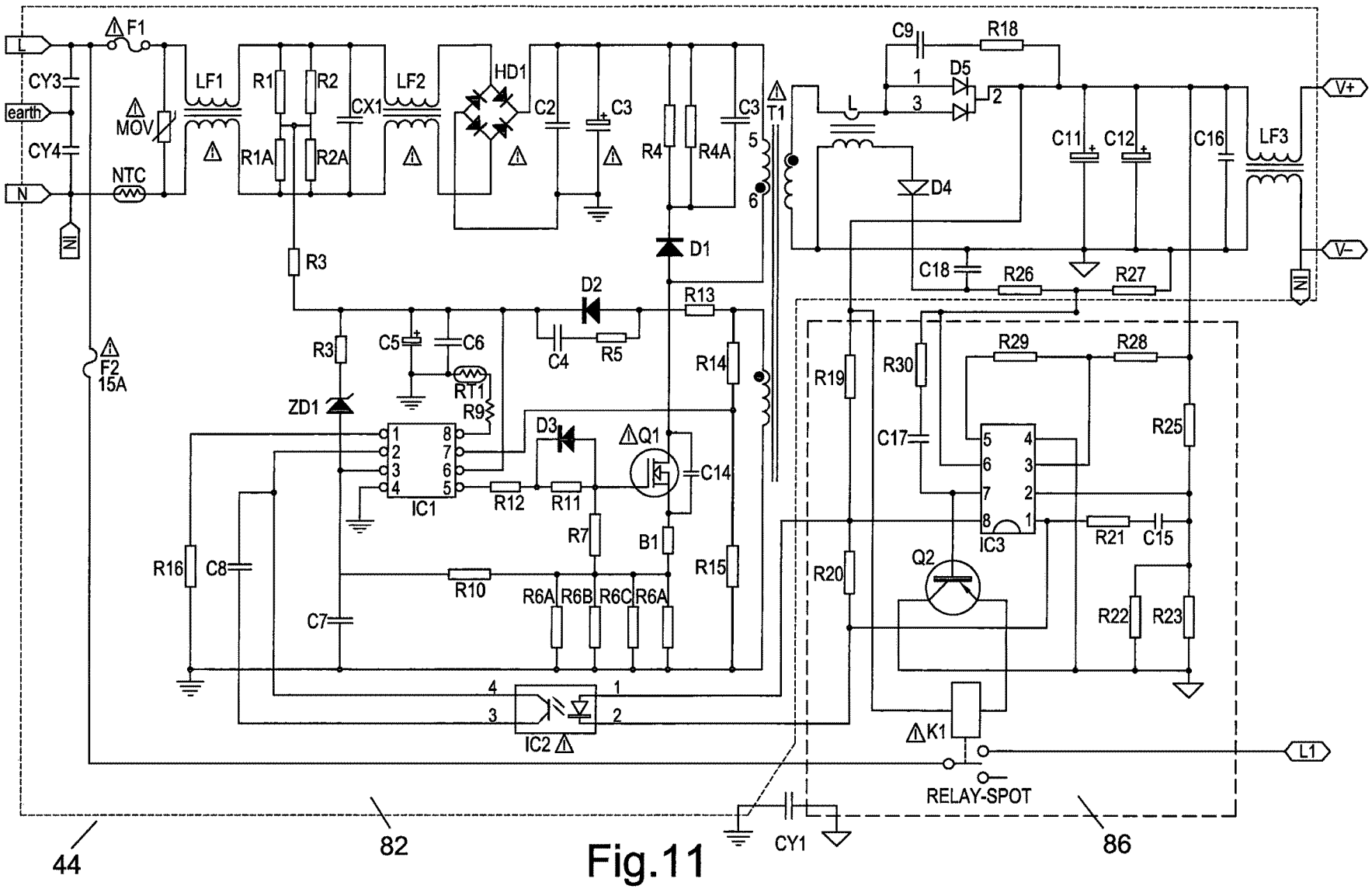
FIG. 11 shows details of the external power supply incorporating an AC power switching circuit, switched mode power supply and circuit for providing a shared neutral/DC supply to the hair dryer.

FIG. 11 shows a schematic of the power supply unit 44 of FIG. 8. The circuit is divided into three elements: the switched mode power supply circuit 82, the AC relay circuit 86 and the output circuit 84 providing a common mode line filter LF3 and shared neutral connection.

On the input side there are AC mains live and neutral connections (nominally 230Vac for UK). An earth connection is also provided to allow more effective EMI filtering.

The switched mode power supply circuit includes common mode line filters LF1 and LF2 on the primary side of transformer T1 to prevent high frequency interferences. Also shown are rectification diodes BD1 and transformer T1 arranged in a quasi resonant flyback configuration to generate a DC power source. This may be any DC voltage suitable for driving a brushless DC motor, such as 12V DC for example.

The AC relay circuit (roughly denoted by the dotted line region 86) operates in a similar manner to the control circuit described in FIG. 10 by detecting delivery of a DC voltage to the V+ rail. On detection of a DC voltage on the secondary side of transformer T1 the relay is activated to connect the live "L" AC input and L1. L1 is then connected to the hair dryer via three core cable 42.

To reduce cord weight between the power supply unit and the actual hair dryer, the neutral connection is coupled with the DC 0V output to provide a common/shared neutral output line. This means that only three conductors are required (+12V, 0V/neutral combination and a switched live as shown in FIG. 11). Within the hair dryer assembly, the +12V line is used to power the fan motor, the switched live is used to power other mains voltage level components such as the heater coil and ioniser. The low voltage 12V DC connection and the mains AC voltage are accordingly connected to different parts of the hair dryer with the only overlap being the current return path for both is on the same conductor: the DC 0V/AC neutral.

The output of the SMPS 82 in FIG. 11 comprises a common mode line filter LF3 to attenuate unwanted high frequencies on the +12V DC output which may radiate as electromagnetic interference (EMI). The circuit has two outputs: V+ and V−, each coupled via a separate side of the line filter LF3 to the SMPS providing a DC output. The main AC neutral input N is also coupled to the V− output (denoted by N1 in FIG. 11). A three core cable including both DC and AC power rails can then used to power the hair dryer.

No doubt many other effective alternatives will occur to the skilled person. It will be understood that the invention is not limited to the described embodiments and encompasses modifications apparent to those skilled in the art lying within the spirit and scope of the claims appended hereto.

Through out the description and claims of this specification, the words "comprise" and "contain" and variations of the words, for example "comprising" and "comprise", means "including but not limited to, and is not intended to (and does not) exclude other moieties, additives, components, integers or steps.

Throughout the description and claims, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example, of the invention are to be understood to be applicable to any other aspect, embodiment or example described herein unless incompatible therewith.

The invention claimed is:

1. A hair dryer having a hand-held housing comprising:

an air inlet and an air outlet;

an air flow assembly between said air inlet and said air outlet to draw air in from said air inlet and drive air out from said air outlet, wherein said air flow assembly comprises a DC powered motor;

a nozzle including a hot air channel and a cool air channel, wherein said hot air channel connects to said air inlet in said hair dryer housing and said cool air channel connects to said air inlet in said hand-held housing, and wherein a cool air channel outlet of said nozzle extends beyond a hot air channel outlet of said nozzle;

a heating element located in an air flow between said air inlet and said air outlet, wherein said air outlet comprises a hot air outlet and a cool air outlet and said hand-held housing comprises a hot air channel through which air is drawn from said air inlet past said heating element to said hot air outlet and a cool air channel through which air is drawn from said air inlet to said cool air outlet, wherein the cool air outlet circumscribes and is generally parallel to the hot air outlet such that two separate streams of air exiting the cool air outlet and the hot air outlet are emitted in the same direction;

a laminar element located in between the heating element and the air outlet, the laminar element being arranged to compensate for a disturbance introduced into the air flow by the heating element;

a sensor that senses activation of the DC powered motor; and a control circuit configured to activate said heating element responsive to said sensor sensing activation of said DC powered motor.

2. The hair dryer according to claim 1, wherein the air flow assembly comprises an integrated fan and motor assembly.

3. The hair dryer according to claim 2, wherein the integrated fan and motor assembly comprises the DC powered motor which is concentrically mounted around a drive shaft and an axial impeller having a plurality of blades which extend radially around the motor and which are connected to the drive shaft to drive the blades.

4. The hair dryer according to claim 3, wherein said integrated fan and motor assembly is housed within a generally cylindrical housing.

5. The hair dryer according to claim 4, wherein a plurality of strakes extend from an inner surface of the cylindrical housing whereby circular air currents within the housing are reduced.

6. The hair dryer according to claim 2, wherein the integrated fan and motor assembly comprises a fan and the DC powered motor concentrically mounted about an axis of rotation of said fan, wherein said fan comprises an axial impeller having a plurality of blades which extend radially around the motor.

7. The hair dryer according to claim 1, wherein said laminar element comprises an array of elongate tubes.

8. The hair dryer according to claim 7, wherein the tubes in said array of elongated tubes is parallel to one another.

9. The hair dryer according to claim 7, wherein at least some of the elongated tubes in said array of elongated tubes have a hexagonal cross-section.

10. The hair dryer as claimed in claim 7, wherein said array of elongated tubes is formed from silicone rubber.

11. The hair dryer as claimed in claim 7, wherein each tube of the array of elongated tubes has a length between 0.5 and 2.0 cm.

12. The hair dryer according to claim 1, wherein the cool air channel is defined by an outer duct which circumscribes the hot air channel.

13. The hair dryer according to claim 1, wherein the cool air channel extends beyond the hot air channel.

14. The hair dryer according to claim 1, further comprising a nozzle having an inlet which matches the outlet of the hairdryer housing and an outlet having a generally rectangular cross-section.

15. The hair dryer according to claim 14, wherein the nozzle is shaped so that the cross-section of the nozzle changes gradually from the nozzle inlet to the nozzle outlet whereby disturbance to the air flow within the nozzle is minimised.

16. The hair dryer according to claim 1, wherein the outlet of the nozzle has a generally rectangular cross section.

17. The hair dryer according to claim 1, wherein said cool air channel of the nozzle and/or housing comprises a plurality of strakes.

18. The hair dryer as claimed in claim 1, further comprising a power supply unit comprising an AC to DC converter for driving at least said DC motor.

19. The hair dryer as claimed in claim 18, wherein said power supply unit is external to said hand-held housing and coupled to said hand-held housing by a power cord.

20. The hair dryer as claimed in claim 18, wherein said power supply unit is configured to deliver both an AC supply and a DC supply to said hand-held housing, and wherein said power supply unit is configured to deliver said AC supply and said DC supply by combining a signal rail of each of said AC and DC supply.

21. The hair dryer as claimed in claim 20, wherein a neutral signal rail of said AC supply is coupled to one of said DC signal rails.

22. The hair dryer as claimed in claim 20, wherein a neutral signal rail of said AC supply is coupled to a 0V rail of said DC signal rails.

23. The hair dryer as claimed in claim 18, wherein said power supply unit comprises said control circuit.

24. The hair dryer as claimed in claim 23, wherein said sensor comprises a current sensor to sense an electrical current input to the DC powered motor.

25. The hair dryer as claimed in claim 23, wherein said control circuit further comprises a relay coupled between a power source and said powered heating element, and wherein said control circuit is configured to activate said relay responsive to said sensing.

26. The hair dryer as claimed in claim 1, wherein said control circuit is configured to sense activation of said DC motor by sensing a DC current delivered to said DC motor.

27. The hair dryer as claimed in claim 1, wherein said control circuit further comprises transistor switch coupled to said relay, and a protection diode connected across said relay.

28. The hair dryer as claimed in claim 1, wherein said heating element is AC powered.

29. The hair dryer as claimed in claim 1, wherein said air flow assembly further comprises a nose cone mounted co-axially with and downstream from said air flow assembly.

30. A hair dryer comprising:

a housing that defines an air inlet and an air outlet, the air inlet having a circular shape;

an air flow assembly located within the housing, the airflow assembly defining a passage fluidly connecting the air inlet and the air outlet and including a DC powered motor, the DC powered motor located proximate the air inlet and concentric with the circular shape;

a heating element located in the passage connecting the air inlet and the air outlet;

wherein the air outlet further includes a hot air outlet and a cool air outlet and the hair dryer housing includes a hot air channel through which air is drawn from the inlet past the heating element to the hot air outlet and a cool air channel through which air is drawn from the air inlet to the cool air outlet;

a nozzle including a hot air channel and a cool air channel, wherein the hot air channel connects to the hot air channel in the hair dryer housing and the cool air channel connects to the cool air channel in the hair dryer housing, and wherein a cool air channel outlet of the nozzle extends beyond a hot air channel outlet of the nozzle;

a laminar element located between the heating element and the air outlet, the laminar element being arranged to compensate for any disturbance introduced into the axial air flow by the heating element;

a sensor electrically coupled to the DC powered motor and configured to detect activation of the DC powered motor; and a control circuit configured to:

receive a signal from the sensor, the signal indicating activation of the DC powered motor, and activate the heating element in response to receiving the signal from the sensor.

* * * * *